US011295570B2

(12) United States Patent
Henry

(10) Patent No.: US 11,295,570 B2
(45) Date of Patent: Apr. 5, 2022

(54) VOTING MACHINE

(71) Applicant: George Henry, Mentor, OH (US)

(72) Inventor: George Henry, Mentor, OH (US)

( * ) Notice: Subject to any disclaimer, the term of this patent is extended or adjusted under 35 U.S.C. 154(b) by 317 days.

(21) Appl. No.: 16/775,378

(22) Filed: Jan. 29, 2020

(65) Prior Publication Data

US 2021/0233343 A1 Jul. 29, 2021

(51) Int. Cl.
*G07C 13/00* (2006.01)

(52) U.S. Cl.
CPC ..... *G07C 13/00* (2013.01); *G07C 13/005* (2013.01); *G06Q 2230/00* (2013.01)

(58) Field of Classification Search
CPC ... G07C 13/00; G07C 13/005; G06Q 2230/00
USPC ..... 235/51, 56, 57
See application file for complete search history.

(56) References Cited

U.S. PATENT DOCUMENTS

2006/0135293 A1* 6/2006 Lake ..... A63B 47/025 473/460
2009/0250510 A1* 10/2009 Kondrashov ..... G07C 13/00 235/51

* cited by examiner

*Primary Examiner* — Daniel A Hess
(74) *Attorney, Agent, or Firm* — Daniel M. Cohn; Howard M. Cohn

(57) ABSTRACT

The improved voting machine includes a housing upon which a plurality of voting canisters are disposed. Each of the plurality of voting canisters housing a plurality of voting balls placed along a track. A voting ball dispenser is mounted to the housing to store and dispense the plurality of voting balls. A selector incorporating a movable ball insertion device to receive one of the plurality of voting balls from the voting ball dispenser moves along the track to dispense the one of the plurality of voting balls into one of the plurality of voting canisters.

20 Claims, 3 Drawing Sheets

VOTING MACHINE

TECHNICAL FIELD OF THE INVENTION

The present invention relates to an improved voting machine, and more particularly to a voting canister to be used in conjunction with an improved voting machine.

BACKGROUND OF THE INVENTION

Current election processes using paper cards and/or ballots have been subject of controversy because of questions concerning their accuracy, potential for voter confusion, and potential for fraud. This is true for machine voting as well as for hand-marked ballots or punch card ("chad" or "chip" removal type) ballots, whether counted by optical scanning or mechanical scanning, which introduce the additional difficulty of determining what is and is not a voted ballot due to incomplete or partial marking of a box or spot or due to the partial or incomplete punching out of a chad or chip. The accuracy and integrity of the voting process and of the counting of ballots is of great concern in any election. As is perhaps most convincingly evidenced by the events surrounding the United States Presidential Election for the year 2000, and particularly in the State of Florida, the lack or perceived lack of accuracy and integrity can cause fear, doubt, distrust and divisiveness and can undermine confidence in government and its institutions.

While some of the foregoing is alleviated by conventional mechanical and more recently by computer-based electronic voting machines utilizing proven and applicable means of data entry such as special keyboards or touch-screens that have been constructed for conventional electronic voting machines, these do not allow or provide any way for personal checking of votes cast to increase the voter's confidence. While the use of computers for vote tabulation and record keeping for each voting machine and/or election can be done with almost zero error, voter confidence in the process is still a subject to be considered. A particular concern relates to the nature of records stored in electronic and magnetic form which are intangible and can be changed without leaving any evidence thereof.

In addition to potential machine and human error, present election and ballot systems do not provide any traceable record for the election choices of individual voters. While the secrecy of each personal ballot is important for various reasons and must be maintained, a voting system and method that would provide confirmation of his or her voting choice(s) to each individual voter and that would further allow the individual voter to compare what has been tallied during the election as his vote to such confirmation would be extremely useful and increase confidence in the integrity and accuracy of the outcome of the voting.

SUMMARY OF THE INVENTION

According to an embodiment of the present invention, there is disclosed an improved voting machine. The improved voting machine includes a housing upon which a plurality of voting canisters are disposed. Each of the plurality of voting canisters housing a plurality of voting balls placed along a track. A voting ball dispenser is mounted to the housing to store and dispense the plurality of voting balls. A selector incorporating a movable ball insertion device to receive one of the plurality of voting balls from the voting ball dispenser moves along the track to dispense the one of the plurality of voting balls into one of the plurality of voting canisters.

According to another embodiment of the present invention, there is disclosed a voting canister to be used in conjunction with an improved voting machine. The voting canister includes a hollow vessel, having two side walls, a top wall, a front wall, and a rear wall. The hollow vessel contains a slot on a top wall into which a mounting bar is inserted, and contains an opening disposed through the top wall through which the voting balls are dispensed. The hollow vessel contains a series of rows each designated by a count label, such that each voting ball falls into place designated by a count label.

BRIEF DESCRIPTION OF THE DRAWINGS

The structure, operation, and advantages of the present invention will become further apparent upon consideration of the following description taken in conjunction with the accompanying figures (FIGS.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
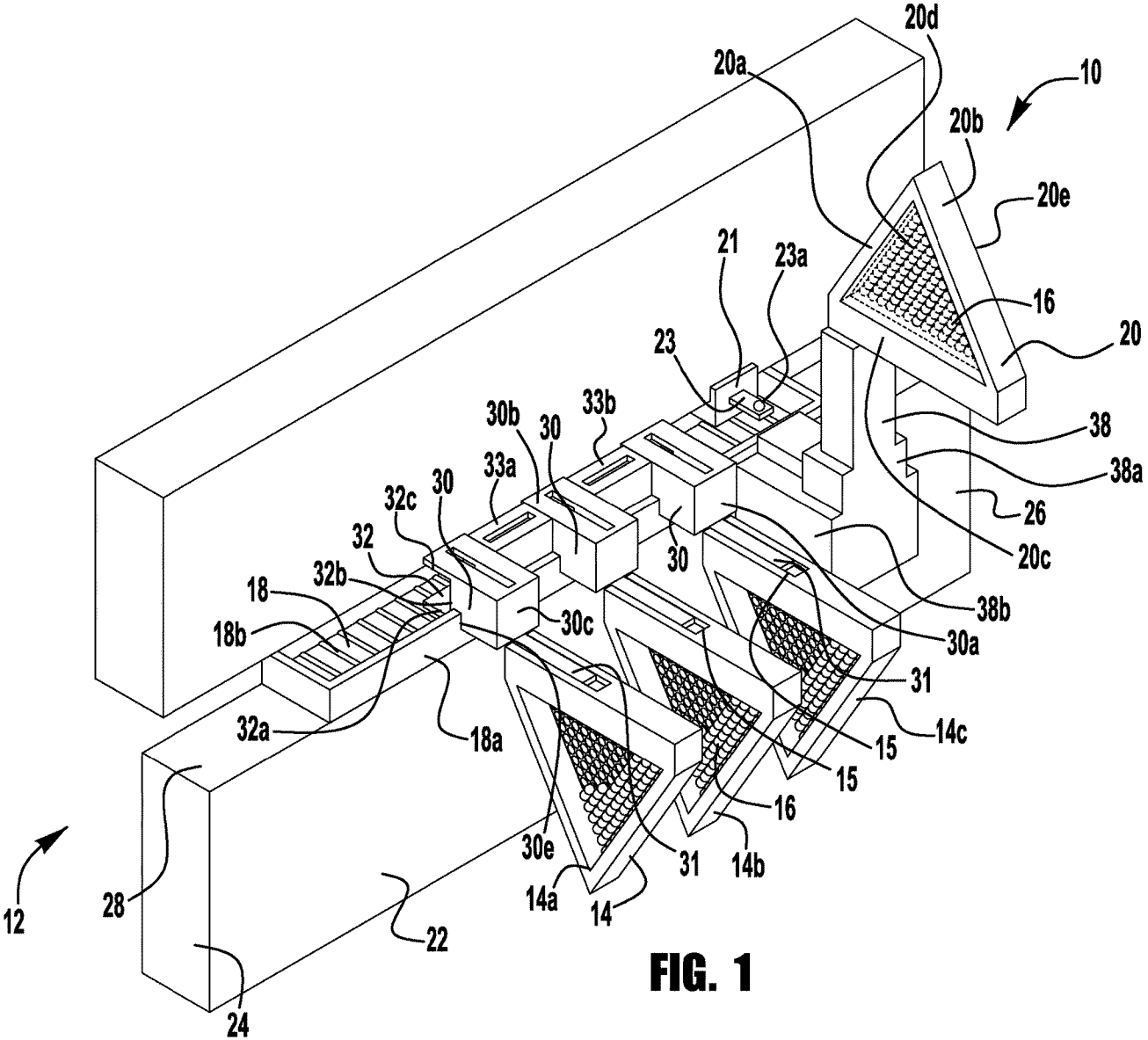
FIG. 1 is a front, three dimensional view of the improved voting machine, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader and should not in any way be interpreted as limiting.

Election results accurately reflecting the choices made by the voters is vital to the democratic process in all kinds of elections, whether they be for governmental offices, changes in laws, or in private elections, such as for offices of an organization. Where the number of voters is small, the paper ballot is acceptable provided honest careful officials supervise the dispensation and counting of ballots. The disadvantages of paper ballots in most large elections are readily apparent. Each vote from each ballot must be manually tallied and accumulated. Apart from the time required, the opportunities for even honest errors is evident.

The improved voting machine 10 is designed to alleviate the various problem associated with traditional and conventional voting machines and methods. Voting machine 10 is designed to be easily controlled to ensure honest voting, while maintaining the secrecy of the ballot.

FIG. 1 illustrates a front, three-dimensional view of the improved voting machine 10. The voting machine 10 is generally constructed of a housing 12 upon which a plurality of voting canisters 14 (14*a*, 14*b*, 14*c*) are disposed. Typically, the housing 12 is designed to be temporality placed on a table or stand during use. Each of the voting canisters 14*a*-14*c* is designed to house a multitude of voting balls 16, each voting ball representing the selection of a voter. The voting canisters 14 are designed to be placed along a track 18.

Figure 3:
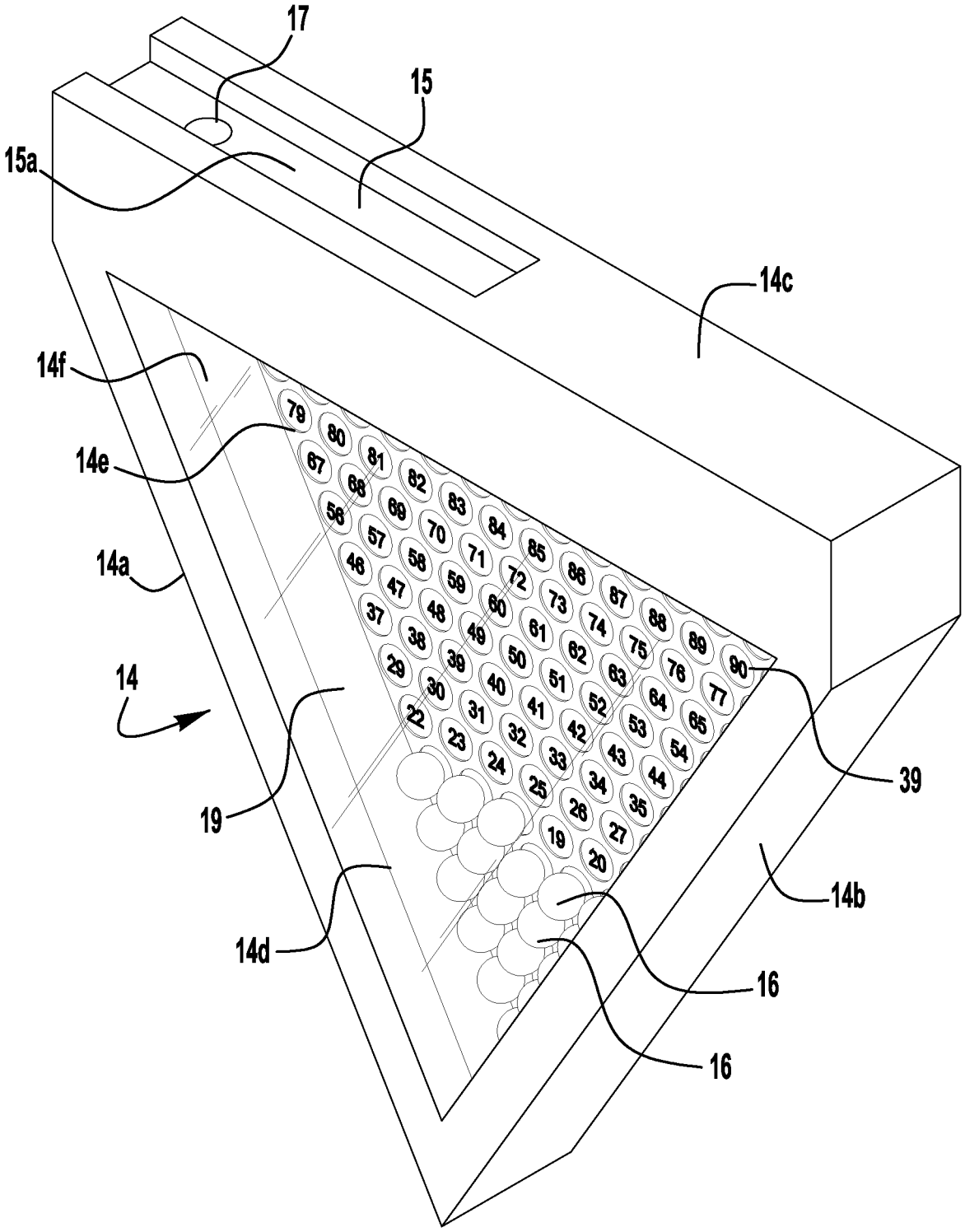
FIG. 3 is a front, three dimensional view of a single voting canister of the improved voting machine, in accordance with the present invention.

A voting ball dispenser 20 is mounted to the housing 12 to store and dispense the multitude of voting balls 16. Each voter who utilizes the voting machine 10 is provided with one of the multitudes of voting balls 16 to be placed in one of the desired voting canisters 14 to represent their vote. The voter employs a selector 21 incorporating a movable ball insertion device 23 to receive a ball from the voting ball dispenser 20, then move along the track 18 and dispense one of the multitudes of voting balls 16 into the desired voting canister 14, as seen in FIG. 3.

Figure 2:
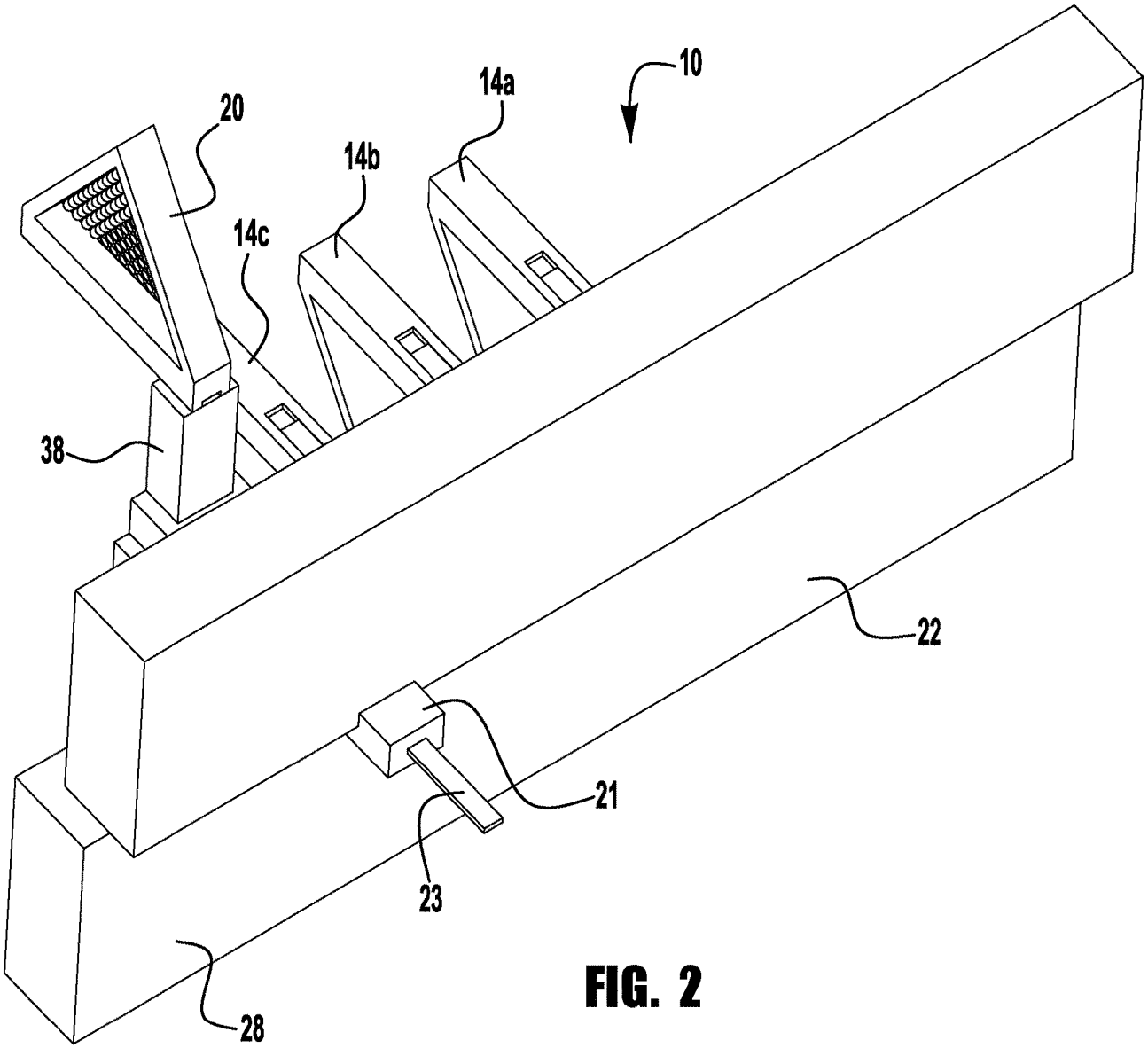
FIG. 2 is a rear, three dimensional detailed view of a portion of the improved voting machine, in accordance with the present invention.

As illustrated in FIGS. 1 and 2, the housing 12 is formed of a main body 22, upon which the track 18 is disposed. The main body 22 may have any desired dimensions, such as a width of between 18 mm and 28 mm, and a height of between 25 mm and 35 mm. The track 18 extends along the main body 22 between first and second end sections 24 and 26 of the housing 22. The track 18 can have a front wall 18*a* which projects above the surface of the elongated base 18*b*. A rear wall 28 extends the length of the main body 22 and is disposed adjacent the track 18 and between the end section 24 and the second end section 26. The track 18 is secured to a rear wall 28 that may have any desired height.

A plurality of spaced mounting blocks 30 onto which the voting ball canisters 14 are removably attached are placed along the track 18 of the voting machine 10. The mounting blocks 30 (same as plurality of spaced canister holders from para. 25?) are each formed of a rectangular shaped mounting block (30*a*, 30*b* and 30*c*) and placed on the track 18 extending along the main body 22. Each of the mounting blocks 30 has a groove 30*e* extending the width of the block and adapted to receive the front wall 18*a* to support the block on the track 18. Each of the mounting blocks 30 includes a mounting bar 31 which extends outward from a front end 30*a* of the mounting block. The mounting bar 31 is shaped as a rectangle and is removably attached in a groove 15 formed on a top end surface 14*c* of the canister 14. A bore 17, typically having a cylindrical shape, extends from the bottom surface 15*a* of the groove 15 to the closed interior opening 19 of the canister 14 as discussed herein below.

The U-shaped rear section 32 of the mounting blocks 30 is formed of a bottom wall 32*a*, a rear wall 32*b*, and a top wall 32*c*. The movable ball device 21 is generally rectangular in shape and is designed to have the appropriate dimensions, such as a width of 10 mm, and a height of 6 mm and 8 mm, to have the ability to move laterally within the U-shaped rear section 32 of the mounting structure 30. Each of the plurality of mounting blocks 30 is designed to mount one of the voting canisters 14. The mounting blocks 30 include a slot opening to the U-shaped rear section 32 adapted to receive the movable ball insertion device 23. The slot has an opening extending through the bottom of the mounting block 30 arranged to overly the bore 17 into the canister and allow the voting ball 16 to fall into the canister 14 when the dispensing structure 23 carried by the movable ball device 21 is positioned so that the voting ball 16 is aligned with the bore 17.

Between each of the rectangular shaped mounting blocks 30 (30*a*, 30*b* and 30*c*) and supported by the track 18 are rectangular shaped spacers 33 (33*a*, 33*b*), respectively. Each of the spacers 33 has a slot 35 extending horizontally therethrough to allow the movable ball insertion device 23 to move through spacer when the movable ball device 21 is moved from one mounting block to another.

A slot is formed the length of the rectangular shaped mounting blocks opening to the sidewall and shaped to receive the movable ball insertion device 23 when the latter is carrying a ball 16. An opening at the end of the slot is arranged to overly an opening through rectangular bar 31 which overlies the opening 17 into the canister. Thus, when the ball insertion device 23 carrying a ball 16 is pushed into the slot formed the length of the rectangular shaped mounting block so that the ball 16 is disposed to overly the bore 17 into the canister and allow the voting ball 16 to fall into the canister 14 when the dispensing structure 23 carried by the movable ball device 21 is pressed into the slot.

The result is the voting balls 16 are dispensed by the movable ball device 21 through one of the openings to reach the voting canister 14.

As seen in FIG. 3, the plurality of voting canisters 14 are adapted to be attached to the rectangular bar 31 projecting outward from the plurality of spaced canister holders 14. The plurality of voting canisters 14 are each formed of a triangular shaped hollow vessel having two side walls 14*a*, 14*b*, and a top wall 14*c*. Although a triangular shaped voting canister 14 is illustrated, it is within the terms of the embodiment that any desired receptacle be utilized.

Preferably, the front and rear walls 14*d* and 14*e* are transparent, and constructed of clear plastic or glass, such that the voting balls 16 contained within the space 19 between the front and rear walls are visible. There is an opening 17 disposed through the top wall 14*c* through which the voting balls 16 are dispensed into the voting canister 14 from the second end 30*a* of the dispensing structure 36. Further, bar 31 are removably secured within the slot 15 disposed within the top wall 14*c*. Thus, the voting canister 14 may be easily removed from the canister holders 30 after use.

Each of the voting canisters 14 contains a series of rows to receive voting balls 16, each designated with a position label 39. Each of the position labels 39 is designed to show cumulative count of the voting balls 16. When each ball 16 is dispensed through the opening 17, it falls into place designated by a count positions. The final vote count is determined by settling all voting balls 16.

The voting ball dispenser 20 is mounted to the housing 12, atop an L-shaped structure 38 having an open channel therethrough. The multitude of voting balls 16 are stored within the voting ball dispenser 20. As illustrated, the voting ball dispenser 20 is a triangular shaped hollow vessel having two side walls 20*a*, 20*b*, a bottom wall 20*c*, and front and rear walls 20*d* and 20*e*. Preferably, the front and rear walls

20*d* and 20*e* are constructed of clear plastic or glass, such that the voting balls 16 contained within the space between the front and rear walls are visible. There is an opening disposed through bottom wall 20*c* through which the voting balls enter the open channel through the L shaped improved voting machine 10. Although a triangular shaped ball dispenser 20 is illustrated, it is within the terms of the embodiment that any desired receptacle be utilized.

The voting ball dispenser 20 is mounted to the L-shaped channel 38, having a hollow vertical section 38*a* and a hollow horizontal section 38*b*. The open channel extends from an opening in the bottom wall 20*c*, through the hollow vertical section 38*a* and a hollow horizontal section 38*b*. The multitude of voting balls 16 are lined up within the hollow vertical sections 38*a* and 38*b*. The hollow indented section 23*a* of the second end 23 of the dispensing structure 31 is inserted into the hollow horizontal section 38*b*, and upon insertion thereinto, a ball is released from the vertical section 38*a* and displaced into the indented section 23*a* of the movable ball insertion device 23.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. An improved voting machine, comprising;

a housing upon which a plurality of voting canisters are disposed;

each of the plurality of voting canisters housing a plurality of voting balls placed along a track;

a voting ball dispenser mounted to the housing to store and dispense the plurality of voting balls; and a selector incorporating a movable ball insertion device to receive one of the plurality of voting balls from the voting ball dispenser, to move along the track and to dispense the one of the plurality of voting balls into one of the plurality of voting canisters.

2. The improved voting machine of claim 1, wherein the housing is formed of a main body upon which the track is disposed.

3. The improved voting machine of claim 2, wherein the track extends along the main body between first and second end sections of the housing.

4. The improved voting machine of claim 3, wherein the track has a front wall which projects above the surface of an elongated base.

5. The improved voting machine of claim 4, wherein the track has a rear wall extending along the main body and disposed adjacent the track and between the first and second end sections of the housing.

6. The improved voting machine of claim 5, wherein a plurality of mounting blocks, onto which the voting ball canisters are removably attached, are placed along the track of the voting machine.

7. The improved voting machine of claim 6, wherein the mounting blocks are each formed of a with a groove extending a width of the block and adapted to receive the front wall of the track to support the block on the track.

8. The improved voting machine of claim 7, wherein the each of the mounting blocks includes a rectangular bar which extends outward from a front end of the mounting block and shaped to be removably attached in a groove formed in a top surface of each of the voting canisters.

9. The improved voting machine of claim 8, wherein a bore extends from a bottom surface of the groove formed on the top surface of each of the voting canisters to a closed interior opening of each of the voting canisters.

10. The improved voting machine of claim 9, wherein a U-shaped rear section of the mounting blocks is formed of a bottom wall, a rear wall, and a top wall, and a slot opening to the U-shaped rear section is adapted to receive the movable ball insertion device as it moves along the track.

11. The improved voting machine of claim 10, wherein the plurality of voting canisters are adapted to be removably attached to a rectangular bar projecting outward from the plurality of spaced mounting blocks.

12. The improved voting machine of claim 11, wherein the plurality of voting canisters each contain a slot in a top wall of the voting canister into which the rectangular bar is inserted.

13. The improved voting machine of claim 12, wherein each of the plurality of voting canisters contains an opening disposed through the top wall through which the voting balls are dispensed into each of the plurality of voting canisters from the ball insertion device.

14. The improved voting machine of claim 13, wherein each of the plurality of voting canisters contains a series of rows each designated by a count label.

15. The improved voting machine of claim 14, wherein the voting ball dispenser is mounted to the housing atop an L-shaped structure, having a hollow vertical section and a hollow horizontal section, and having an open channel therethrough.

16. The improved voting machine of claim 14, wherein the voting ball dispenser includes an opening disposed through a bottom wall through which the voting balls enter the open channel.

17. A voting canister to be used in conjunction with an improved voting machine, comprising;

hollow vessel;

the hollow vessel having two side walls, a top wall, a front wall, and a rear wall;

the hollow vessel containing a slot on a top wall into which a mounting bar is inserted;

the hollow vessel containing an opening disposed through the top wall through which the voting balls are dispensed;

the hollow vessel containing a series of rows each designated by a count label, such that each voting ball falls into place designated by a count label.

18. The voting canister of claim 17, wherein the hollow vessel is triangular in shape.

19. The voting canister of claim 17, wherein the front and rear walls are transparent, such that the voting balls contained within the space between the front and rear walls are visible.

20. The improved voting machine of claim 19, wherein a bore extends from a bottom surface of a groove formed on a top surface of the voting canister to a closed interior opening of the voting canister.

* * * * *